US005462003A

United States Patent [19]

Fox et al.

[11] Patent Number: 5,462,003

[45] Date of Patent: Oct. 31, 1995

[54] MINIMUM DISPLACEMENT SUBMARINE ARRANGEMENT

[75] Inventors: Robert F. Fox, Westerly, R.I.; Peter D. Canning, Stonington, Conn.

[73] Assignee: General Dynamics Corporation, Falls Church, Va.

[21] Appl. No.: 222,536

[22] Filed: Apr. 4, 1994

[51] Int. Cl.[6] ..... B63G 8/28

[52] U.S. Cl. ..... 114/316; 114/341

[58] Field of Search ..... 114/316–321, 324, 114/341, 342

[56] References Cited

U.S. PATENT DOCUMENTS

| | | | |
|---|---|---|---|
| 926,007 | 6/1909 | Lake et al. | 114/341 |
| 1,154,215 | 9/1915 | Spear | 114/341 |
| 1,511,902 | 10/1924 | Mugler et al. | 114/341 |
| 1,777,416 | 10/1930 | Pratt | 114/316 |
| 2,379,295 | 6/1945 | Gunning | 114/341 |
| 4,153,001 | 5/1979 | Krasberg | 114/312 |

FOREIGN PATENT DOCUMENTS

| | | | |
|---|---|---|---|
| 639488 | 7/1934 | Germany | 114/316 |
| 715120 | 10/1966 | Italy | 114/342 |
| 421029 | 12/1934 | United Kingdom | 114/317 |

*Primary Examiner*—Edwin L. Swinehart
*Attorney, Agent, or Firm*—Brumbaugh, Graves, Donohue & Raymond

[57] ABSTRACT

A submarine arrangement comprising a double hull construction forward having a wasp waist section minimizes ship displacement and permits storage of weapons in the wasp waist section.

13 Claims, 3 Drawing Sheets

MINIMUM DISPLACEMENT SUBMARINE ARRANGEMENT

BACKGROUND OF THE INVENTION

This invention relates a submarine arrangement, and more specifically to a submarine arrangement minimizing the ship's displacement while maximizing weapons payload and ship capability.

Conventional nuclear submarines incorporate a torpedo room for weapons storage which is internal to a pressure hull. Typically, this arrangement also includes tubes which penetrate the inner hull and extend to the outer hull to allow weapons launch. The large internal space requirement for weapons storage and handling in such an arrangement increases the volume, and, therefore the displacement of the ship. An internal torpedo room also requires additional equipment to load weapons down through several levels of the ship into the tubes. Handling platforms, hydraulic valves, air systems, etc. are required to deliver weapons to the tubes. Moreover, alignment of the torpedo tubes and weapons handling equipment is difficult and costly. In addition, the fact that the torpedo tubes penetrate the inner pressure hull results in both an increase in ship cost and a greater risk of flooding. Additionally, the storage of weapons internal to the pressure hull governs a need for additional variable ballast tankage to compensate for the loss in ship's weight after weapons ejection.

SUMMARY OF THE INVENTION

Accordingly, it is an object of the present invention to provide a minimum displacement submarine arrangement which overcomes the cost and disadvantages of the prior art.

Another object of the invention is to provide a submarine arrangement which minimizes ship displacement while maximizing weapons payload and ship capability and which is less expensive than conventional submarine arrangements.

These and other objects of the invention are attained by providing a submarine having an inner hull with a wasp waist section in which weapons may be located external to the inner hull. In this way, the invention allows for weapons payload storage and delivery without penetration of the inner pressure hull, minimizing variable ballast requirements, minimizing torpedo handling support systems, and, maximizing the effective use of space within the submarine.

BRIEF DESCRIPTION OF THE DRAWINGS

Further objects and advantages of the present invention will be more fully appreciated from a reading of the following detailed description when considered with the accompanying drawings wherein.

DESCRIPTION OF PREFERRED EMBODIMENTS

Figure 1:
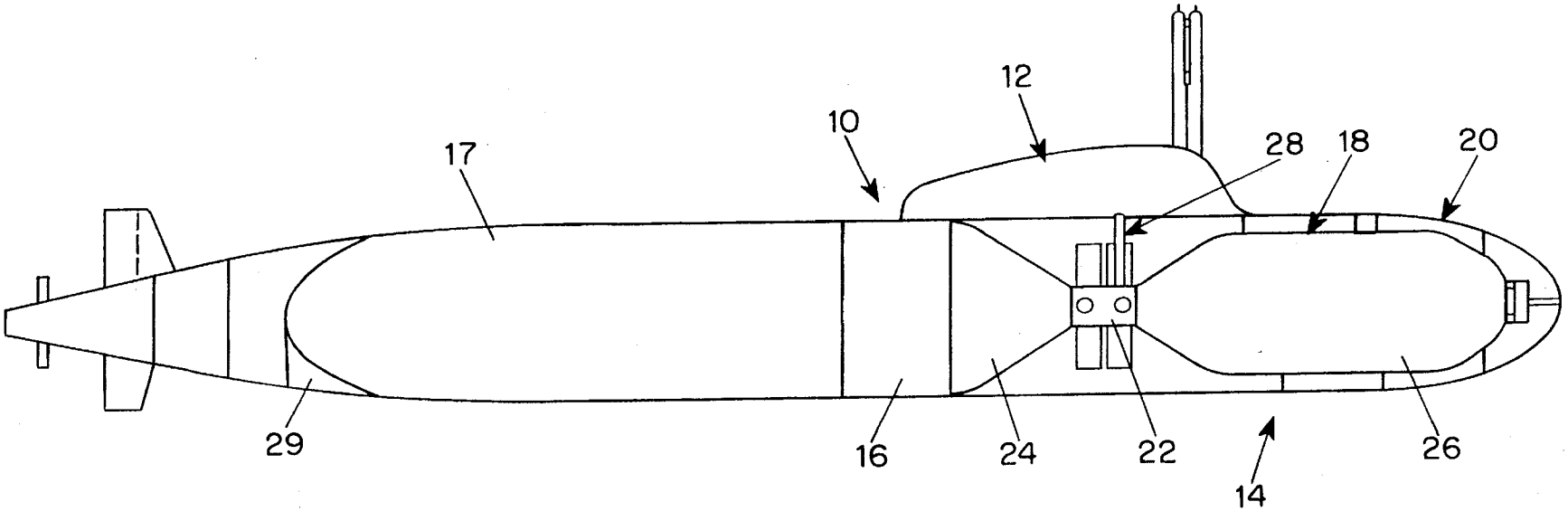
FIG. 1 is a schematic view in elevation showing a representative embodiment of a minimum displacement submarine arrangement in accordance with the invention.

In the representative embodiment of the invention illustrated schematically in FIG. 1, a submarine 10 has a generally centrally located fairwater 12, a forward portion 14, a central reactor compartment 16 and an aft portion 17 including an engine room. The forward portion 14 has a double hull structure which comprises an inner hull 18 and an outer hull 20. The inner hull is formed in an hour glass shape to provide a narrow wasp waist section 22.

Figure 2:
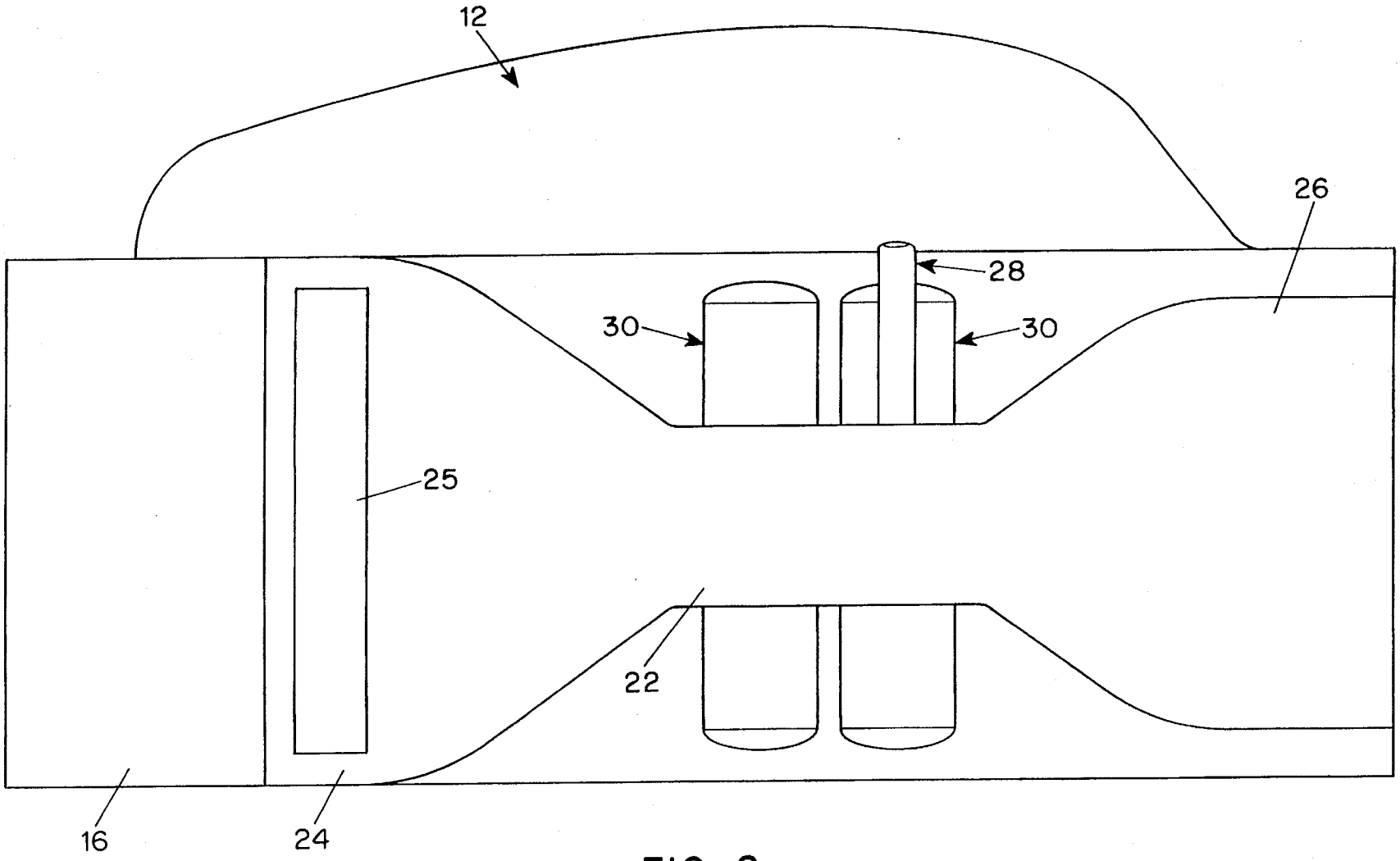
FIG. 2 is an enlarged fragmentary schematic view showing a portion of the minimum displacement submarine arrangement illustrated in FIG. 1.

As best seen in FIG. 2, the narrow wasp waist section 22 includes a tunnel connecting a compartment 24 which is adjacent to the reactor compartment 16 with the forward compartment 26. A vertical tube 28 provides access between the wasp waist section and the fairwater 12. The wasp waist section 22 and the double hull construction in the forward portion provide space for weapons storage.

Except for the sanitary and potable water tanks in the bilge, there are no variable ballast tanks in the forward compartment. Instead, variable ballast tanks 25 are located forward of the reactor compartment 16 in the compartment 24, and at the aft end of the aft portion 17. In this regard, the positioning of weapons at a location external to the inner hull amidship in an area adjacent to the wasp waist section 22 eliminates the requirement for additional variable ballast tanks forward of the compartment 24. Thereby eliminating seawater piping in the forward compartment 26.

Figure 3:
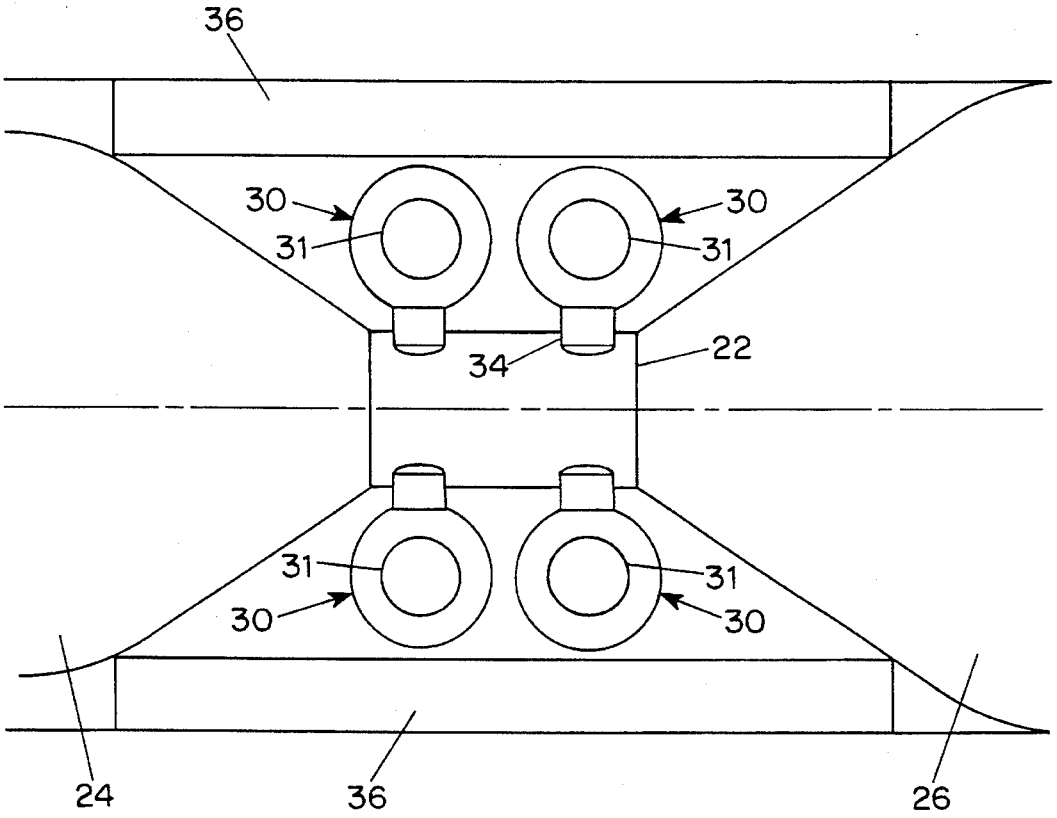
FIG. 3 is an enlarged bottom fragmentary schematic view showing a portion of the minimum displacement submarine arrangement illustrated in FIG. 1.

An enlarged bottom view of the wasp waist section 22 is shown in FIG. 3. The wasp waist 22 and the double hull construction forward provide space for up to four reconfigurable mission tubes 30. Reconfigurable mission tubes are capable of being outfitted for specific missions including strike warfare (tomahawk missiles), mine laying (gravity dropped mines 31), or special operations (equipment storage/diver lock-out). The mines may be launched by gravity releasing them from their cartridges and dropping them through a bottom hatch opening in the mission tube (not shown). Typically, the mission tubes remain dry before deploying weapons, and after the weapons are launched, they are flooded with sea water thereby minimizing variable ballast tank requirements. Each of the mission tubes has a hatch 34 to provide access from the tunnel in the wasp waist section 22 to the mission tube.

The mission tubes may also contain other special warfare equipment. A dry storage tube can be used to store equipment which requires careful handling such as ordinance, small arms, and weapons with solid-propellant motors. The mission tube may also be provided with a hyperbaric chamber for accommodating human divers. A wet storage tube suitably pressurized for diver occupancy permits diver access for servicing of equipment before and after use. Equipment may be placed in the upper end of the tube which is drained and equalized with the ship's ambient pressure after bottom hatch closure for easy servicing.

In addition, the wasp waist section 22 is arranged to accommodate external weapons modules 36. These modules may include an external weapons clip from which stored weapons may be launched. The modules 36 shown in FIG. 3 may contain torpedoes, missiles, or the like and may be extendable to facilitate launching. Such modules are described in more detail in the copending Perkowski et al. U.S. patent application Ser. No. 08/222,450 filed for "Submarine External Weapons Clip" assigned to the same assignee as the present application.

Although the invention has been described herein with reference to specific embodiments, many modifications and variations therein will readily occur to those skilled in the art. Accordingly, all such variations and modifications are included within the intended scope of the invention.

We claim:

1. A minimum displacement submarine comprising a body with forward and aft portions, the forward portion comprising an inner hull and outer hull, the inner hull being formed with a wasp waist, a extending over the forward portion fairwater extending over the forward portion, and a vertical tube between the wasp waist and fairwater.

2. A minimum displacement submarine according to claim 1 wherein the forward portion comprises a forward compartment, and including variable ballast tanks locate solely aft of the forward compartment of the submarine.

3. A minimum displacement submarine according to claim 1 wherein weapons are stored between the inner and outer hull.

4. A minimum displacement submarine according to claim 3 wherein the weapons are stored amidships in the wasp waist section.

5. A minimum displacement submarine according to claim 4 wherein the weapons are stored in mission tubes located in the wasp waist section.

6. A minimum displacement submarine according to claim 5 wherein the mission tubes have a bottom hatch for release of mines and gravity dropped mines are stored in the mission tubes.

7. A minimum displacement submarine according to claim 5, wherein each mission tube comprises a hatch to provide access from the wasp waist to the mission tube.

8. A method of minimizing displacement of a submarine comprising the steps of:

providing a submarine having a body with forward and aft portions fairwater extending over the forward portion, the forward portion comprising an inner hull and outer hull wherein the inner hull is formed with a wasp waist, providing a vertical tube between the wasp waist and the fairwater, and storing weapons between the inner and outer hull.

9. A method according to claim 8 further comprising storing the weapons amidships in the wasp waist section.

10. A method according to claim 8 wherein the forward portion comprises a forward compartment and further comprising locating variable ballast tanks solely aft of the forward compartment.

11. A method according to claim 9 further comprising storing the weapons in mission tubes located in the wasp waist section.

12. A method according claim 11 wherein the mission tubes have a bottom hatch for release of mines and gravity dropped mines are stored in the mission tubes.

13. A method of minimizing displacement of a submarine according to claim 11 further comprising providing a hatch for each mission tube to provide access from the wasp waist to the mission tube.

* * * * *

UNITED STATES PATENT AND TRADEMARK OFFICE

CERTIFICATE OF CORRECTION

PATENT NO. : 5,462,003

DATED : October 31, 1995

INVENTOR(S) : Robert F. Fox and Peter D. Canning

It is certified that error appears in the above-indentified patent and that said Letters Patent is hereby corrected as shown below:

Col. 1, line 7, "relates" should read --relates to--

Col. 3, line 8, "a extending" should read --a fairwater extending--

Col. 3, line 9, delete "fairwater extending over the forward portion"

Col. 3, line 13, "locate" should read --located--

Col. 4, line 5, "portions" should read --portions and a--

Signed and Sealed this

Twenty-sixth Day of March, 1996

Bruce Lehman

*Attest:*

BRUCE LEHMAN

*Attesting Officer*

*Commissioner of Patents and Trademarks*